US005679934A

United States Patent [19]

Juntunen et al.

[11] Patent Number: 5,679,934

[45] Date of Patent: Oct. 21, 1997

[54] PROGRAMMABLE OPERATING PANEL FOR AN ELEVATOR CAR

[75] Inventors: Asko Juntunen; Matti Kähkipuro, both of Hyvinkää, Finland

[73] Assignee: Kone OY, Helsinki, Finland

[21] Appl. No.: 545,924

[22] Filed: Oct. 20, 1995

[30] Foreign Application Priority Data

Oct. 21, 1994 [FI] Finland ..... 944980

[51] Int. Cl.[6] ..... B66B 1/34

[52] U.S. Cl. ..... 187/395; 187/384; 187/394

[58] Field of Search ..... 187/395, 393, 187/394, 384

[56] References Cited

U.S. PATENT DOCUMENTS

| | | | |
|---|---|---|---|
| 4,716,992 | 1/1988 | Kunii | 187/121 |
| 4,880,665 | 11/1989 | Adler et al. | 427/126.3 |
| 4,989,694 | 2/1991 | Ueshima et al. | 187/121 |
| 5,010,472 | 4/1991 | Yoenda et al. | 364/148 |
| 5,042,621 | 8/1991 | Ovaska et al. | 187/133 |

FOREIGN PATENT DOCUMENTS

| | | | |
|---|---|---|---|
| 1-288584 | 11/1989 | Japan | 187/395 |
| 2-123081 | 5/1990 | Japan . | |
| 3-147685 | 7/1991 | Japan . | |
| 5-780 | 1/1993 | Japan | 187/393 |
| 2241090 | 8/1991 | United Kingdom | B66B 1/20 |

*Primary Examiner*—Robert Nappi

[57] ABSTRACT

An operating panel (5) for an elevator car, containing car call buttons (7), signalling devices and other signs representing information. The control panel of the elevator car is replaced with a touchscreen display (1) incorporating a passage control feature. The touchscreen display (1) is also used as a maintenance tool for the checking of elevator equipment.

9 Claims, 3 Drawing Sheets

PROGRAMMABLE OPERATING PANEL FOR AN ELEVATOR CAR

The present invention relates to an operating panel for an elevator.

It is known that an elevator has an operating panel which is used to control the elevator from the car to send it to a desired floor. The operating panel contains an alarm button and a stop button. When the alarm button is pressed, an alarm is transmitted e.g. to the caretaker or to an alarm bell installed on the ground floor. The stop button can be used to stop the elevator as needed before it arrives to the requested floor or in an emergency. The button for the ground floor has often a different colour or a larger size than the other push buttons to make it easy to identify. Car call buttons are generally implemented as push buttons or touchpanel buttons that respond to a mere touch of a finger.

In large systems, the operating panels in the cars also contain various information plates, a microphone, a loudspeaker, a fan control button and a display showing the floor number. In addition to the normal call buttons, the car panel is also provided with an overload indicator, door control buttons and an intercom.

The operating panel of an elevator car is the only component which has to be provided with perforations according to order. If, for example, the customer should later wish to alter the order of the buttons in the operating panel, this is practically impossible to do except by ordering a new panel with a different set of perforations.

To provide a solution to the drawbacks mentioned above, a new arrangement in the operating panel of an elevator car is presented as an invention.

SUMMARY OF THE INVENTION

In the solution of the invention, the car operating panel is provided with a touchscreen display, making it possible always to order a standard part which is then customized on site and which can also be later modified by programming.

The advantages achieved by the invention include the following:

- Buttons of any shape and size and a call reset light of any type can be formed on the display by programming
- The call buttons can be placed in an arbitrary order
- A reset light of any shape can be formed, and its brightness can be varied
- The same display can be used to show the elevator position and the travel/starting direction
- The same display can be used to present other messages to guide the passenger, e.g. an index of inhabitants in the building etc.
- Floors blocked off can be hidden by removing the relevant buttons from the display
- The same screen can also contain a set of buttons for entering code numbers and passwords in a passage control mode placed in a separate field, obviating the need to use a separate passage control apparatus
- Key switch functions can be incorporated in the field
- The serviceman can use the screen as a tool for elevator maintenance without having to enter into the machine room as failure information can be displayed directly on the same screen
- Travel curves can be output to the screen and the parameters of the curve form can be changed; parameters relating to door operation can similarly be changed from the car

- The equipment on a given floor can be tested by driving the car to the floor in question and activating the tests for that floor through the touchscreen display
- The floor bell sound volume can be adjusted to a desired level and the volume level can be heard directly as the car is at the floor
- A car panel of a neater and more elegant design can be produced as the panel need not be sprinkled with such a variety of devices of different designs.

BRIEF DESCRIPTION OF THE DRAWINGS

In the following, an embodiment of the invention is described by the aid of application examples by referring to the attached drawings, in which.

DETAILED DESCRIPTION OF THE PREFERRED EMBODIMENTS

Figure 1:
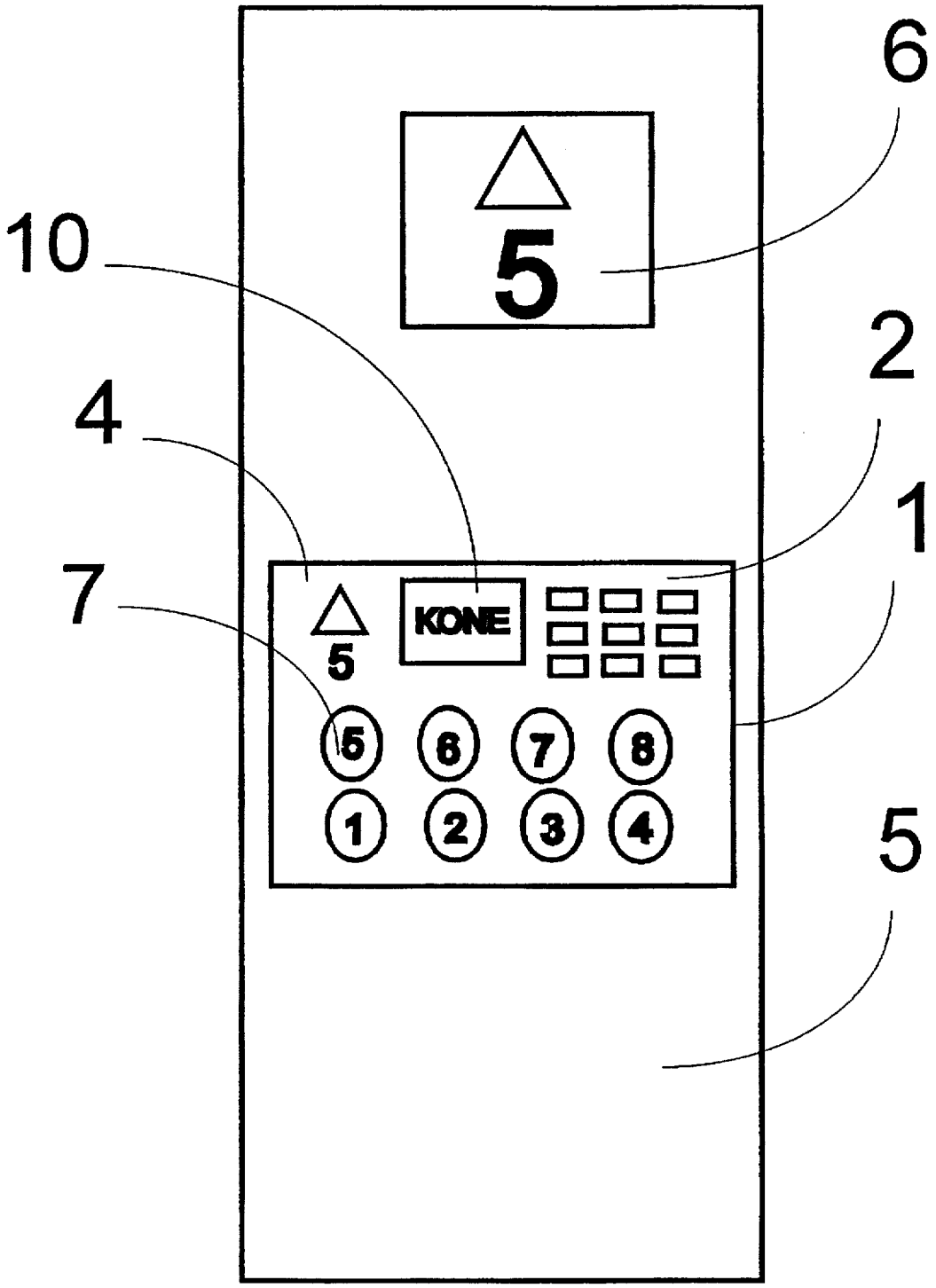
FIG. 1 presents a touchscreen display as provided by the invention.

FIG. 1 shows an operating panel 5 for an elevator car, provided with a touchscreen display 1. The touchscreen 1 contains various functions, such as a position indicator field 4 and a message field 2, which can display various messages and information about the operation of the elevator. The touchscreen 1 also contains ordinary floor call buttons 7. The message field can be used to display lists of information and it can contain a so-called passage control display as a separate field, making it unnecessary to use a separate passage control apparatus. The operating panel 5 is made of a metal, e.g. steel, and it is often provided with an additional display 6 indicating the current floor and travelling direction of the elevator. This operating panel 5 is provided with a touchscreen display 1 which is programmed to work with normal car call buttons and it can also be programmed according to the characteristic information relating to the building and the elevator, to display address information, the travelling direction and other messages.

Figure 2:
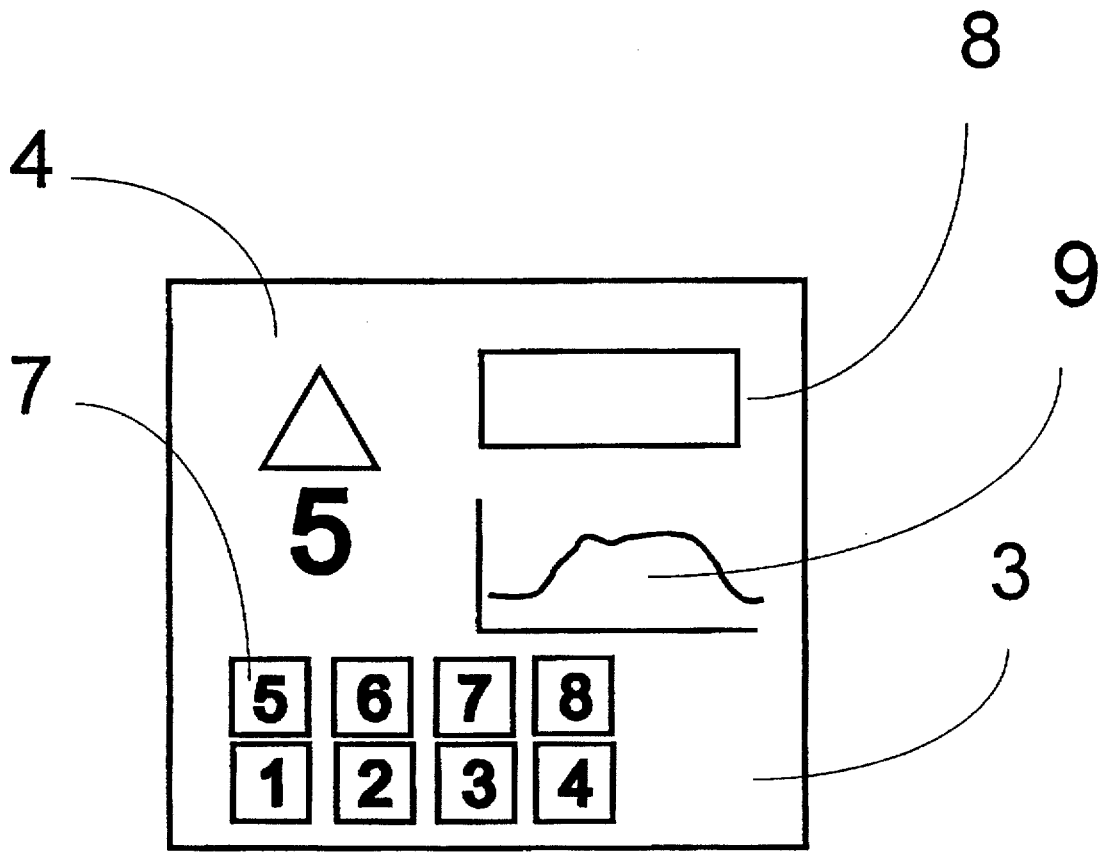
FIG. 2 illustrates the maintenance mode

FIG. 2 represents a maintenance mode, which can alternatively be used in the operating panel 5 in an elevator car. The maintenance mode 3 comprises a position indicating field 4, a failure display 8 showing the most typical faults in an elevator, such as a door contact fault etc. and it can also be used for the checking of other equipment. Furthermore, the travel curves 9 of the elevator can be output to the touchscreen 1. These indicate how the elevator travels from one floor to another. The maintenance mode 3 also comprises ordinary floor call buttons 7, which can be easily rearranged in a different order. Buttons of a desired shape, colour and size are also formed on the touchscreen display 1 by programming. Floors blocked off are masked by removing them altogether from the touchscreen display 1. The touchscreen display 1 can also be used to represent signalling devices. This allows the floor bell sound volume to be adjusted to a desired level. The bell volume is heard directly as the car is at the floor. A call reset light of any kind can also be programmed.

Figure 3:
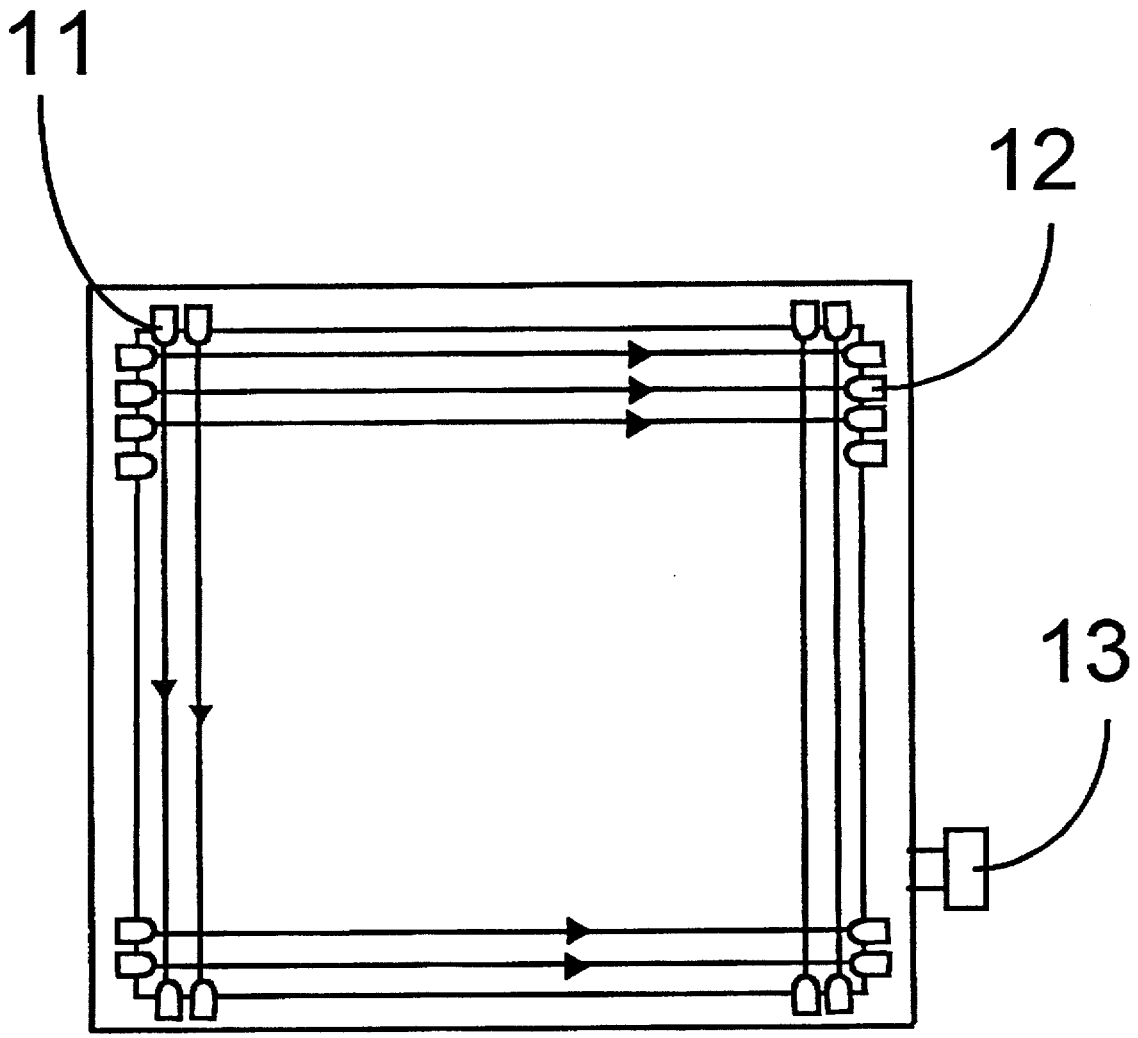
FIG. 3 presents a matrix having light emitting/receiving diodes.

FIG. 3 represents a matrix formed using light emitting/receiving diodes. The matrix has emitting diodes 11 and receiving diodes 12 and a connector 13 for the control electronics to which the information is transmitted from the operating panel. The matrix field is scanned by light beams to find points where the light beam is interrupted. When such a point is encountered, a corresponding function is activated. After that, this function is read by a process, whereupon the information is transmitted via serial communication to the control unit.

It is obvious to a person skilled in the art that the embodiments of the invention are not restricted to the examples described above, but that they may instead be varied in the scope of the following claims. The scanning element may be e.g. a capacitive, resistive or inductive element.

We claim:

1. An operating panel for an elevator car, said panel comprising:

car call buttons; and signalling devices; wherein the operating panel is implemented as a touchscreen display programmable to function as a normal car call button set and as a car call indicator, the touchscreen further being configurable to function in a maintenance mode in which the screen displays functions, buttons and messages for maintenance purposes, and further wherein, in the maintenance mode, the touchscreen display contains a position indicating field, a failure display and one or more fields showing elevator travel curves as well as ordinary car call buttons.

2. An operating panel for an elevator car according to claim 1, further comprising an additional position indicating field included in the operating panel.

3. An operating panel for use in an elevator car, comprising:

a touchscreen; and a controller for selectively operating said touchscreen in a maintenance mode and a non-maintenance mode, wherein, in the maintenance mode, said touchscreen is controlled to selectively display:

a first plurality of floor call buttons for the floors serviced by the elevator car, a first position indicating field for indicating a position and direction of travel of the elevator car, a failure display field for identifying faults in the elevator, and travel curves for the elevator car; and further wherein, in the non-maintenance mode, said touchscreen is controlled to selectively display:

a second plurality of floor call buttons, a second position indicating field for indicating a position and direction of travel of the elevator car, and a message field providing information to passengers.

4. The operating panel according to claim 3, further comprising a display device, wherein said controller controls said display device to display information corresponding to data displayed by said touchscreen.

5. The operating panel according to claim 4, wherein, in the non-maintenance mode, the information displayed by said display device includes data displayed in the second position indicating field.

6. The operating panel according to claim 3, wherein said controller controls said touchscreen such that an appearance of each floor call button in the first plurality of floor call buttons is different than an appearance of each floor call button in the second plurality.

7. The operating panel according to claim 3, wherein the floor call buttons in the first plurality appear as one of ovals and rectangles, and the floor call buttons in the second plurality appear as the other of ovals and rectangles.

8. The operating panel according to claim 3, wherein the first plurality of floor call buttons includes more floor call buttons than the second plurality of floor call buttons.

9. The operating panel according to claim 3, wherein floors blocked off from access are not displayed in the second plurality of floor call buttons.

* * * * *